US007063548B2

(12) United States Patent
Ohara

(10) Patent No.: US 7,063,548 B2
(45) Date of Patent: Jun. 20, 2006

(54) CONNECTOR AND CONNECTOR ASSEMBLY

(75) Inventor: Koji Ohara, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/251,942

(22) Filed: Oct. 17, 2005

(65) Prior Publication Data

US 2006/0084304 A1 Apr. 20, 2006

(30) Foreign Application Priority Data

Oct. 19, 2004 (JP) ..... 2004-304442

(51) Int. Cl.
*H01R 13/62* (2006.01)

(52) U.S. Cl. ..... 439/157

(58) Field of Classification Search ..... 439/157, 439/489, 490, 159

See application file for complete search history.

(56) References Cited

U.S. PATENT DOCUMENTS 5,823,809 A * 10/1998 Wakata ..... 439/157
6,319,050 B1 * 11/2001 Miyazaki et al. ..... 439/489
6,361,337 B1 * 3/2002 Kurimoto ..... 439/157
6,419,507 B1 * 7/2002 Kurimoto ..... 439/157

FOREIGN PATENT DOCUMENTS

JP 2002-141145 5/2002

* cited by examiner

*Primary Examiner*—Phuong Dinh
(74) *Attorney, Agent, or Firm*—Gerald E. Hespos; Anthony J. Casella

(57) ABSTRACT

A lever (50) is mounted rotatably on a female housing (10). A resiliently deformable detector (80) is so assembled into the lever (50) and is movable between a standby position and a detecting position. The detector (80) contacts a stopper (70) in an accommodating portion (60) of the lever (50) when the female and male housings (10, 30) are not yet properly connected to prevent the lever (50) from being pushed to the detecting position. However, the detector (80) contacts an unlocking projection (29) on the female housing (10) and deforms away from the stopper (70) when the housings (10, 30) reach a properly connected state. As a result, the detector (80) can be pushed to the detecting position. An ability to move the detector (80) to the detecting position indicates that the housings (10, 30) are connected properly.

10 Claims, 14 Drawing Sheets

CONNECTOR AND CONNECTOR ASSEMBLY

BACKGROUND OF THE INVENTION

1. Field of the Invention

The invention relates to a connector and to a connector assembly with a function of detecting a connected state.

2. Description of the Related Art

Japanese Unexamined Patent Publication No. 2002-141145 discloses a connector that can detect a connected state. This connector has male and female housings that are connectable with one another. The female housing has a lock arm that is deformed in the process of connecting the two housings and is resiliently restored when the housings are connected properly to engage the male housing. A detector is assembled into the female housing and is movable between a standby position where the detector is retracted from a deformation space for the lock arm and a detecting position where the detector is in the deformation space. The detector contacts the lock arm in the deformation space if an attempt is made to push the detector from the standby position to the detecting position while the housings are connected only partly connected. Thus, the detector cannot be pushed to the detecting position. On the other hand, the locking arm exits the deformation space if the two housings are connected properly. Thus, the detector can be pushed to the detecting position, and the connected state of the two housings can be detected.

The construction of the accommodating portion for the above described detector is complicated, and the construction of a forming die for forming the female housing is complicated. Thus, production costs are high.

The present invention was developed in view of the above problem and an object thereof is to design a connector and connector assembly provided with a function of detecting a connected state such that the construction of a forming die for forming a housing can be simplified.

SUMMARY OF THE INVENTION

The invention relates to a connector with a housing that is connectable with a mating housing. A movable member is mounted movably on the housing and has at least one cam surface that can display a cam action in cooperation with at least one follower on the mating housing. A resiliently deformable detector is assembled into the movable member and is movable between a standby position and a detecting position. The detector contacts a stopper on the movable member when the housing is not yet connected properly with the mating housing to prevent the detector from being pushed from the standby position to the detecting position. The detector contacts an unlocking portion on the housing and deforms away from the stopper when the housing is connected properly with the mating housing. Thus, the detector can be pushed to the detecting position.

The detector contacts the stopper and is prevented from being pushed to the detecting position if the housing is left partly connected with the mating housing. However, the detector contacts the unlocking portion on the housing and is deformed resiliently in a direction to disengage from the stopper when the housing is connected properly with the mating housing. Thus, the detector can be pushed to the detecting position. Accordingly, movement of the detector to the detecting position confirms that the housing has been connected properly to the mating housing. The connector avoids the need to provide the housing with a special member other than the unlocking portion. Therefore, the forming die for forming the housing has a simple construction.

The movable member preferably comprises a lever rotatably mounted on the housing, and the housing is connected properly with the mating housing by a cam action generated by rotating the lever.

The detector preferably includes a main portion projecting substantially in a pushing direction of the detector and the movable member includes an accommodating portion for accommodating the detector.

The accommodating portion preferably is formed with a guide hole for receiving a free end of the main portion and for guiding the detector to the detecting position.

The housing preferably has a receiving portion that communicates with the guide hole when the housing is connected properly with the mating housing. The main portion enters the receiving portion as an operable portion of the detector is pushed, and the movable member is locked in the housing. Thus, a separate lock for the movable member is unnecessary A detachment preventing portion is provided at the movable member for preventing detachment of the detector.

The detector can be moved between the standby position and the detecting position in a direction intersecting a movement direction of the movable member.

The detector preferably is at the standby position, and an operable portion of the detector contacts at least one auxiliary stopper of accommodating portion of the movable element for accommodating the detector and preventing the detector from being pushed to the detecting position.

At least one guide rib preferably is provided on one of the housing and the mating housing and slides in contact with guide grooves on the other of the housing and the mating housing as the two housings are connected. Thus, the two housings are held in postures for proper orientation.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
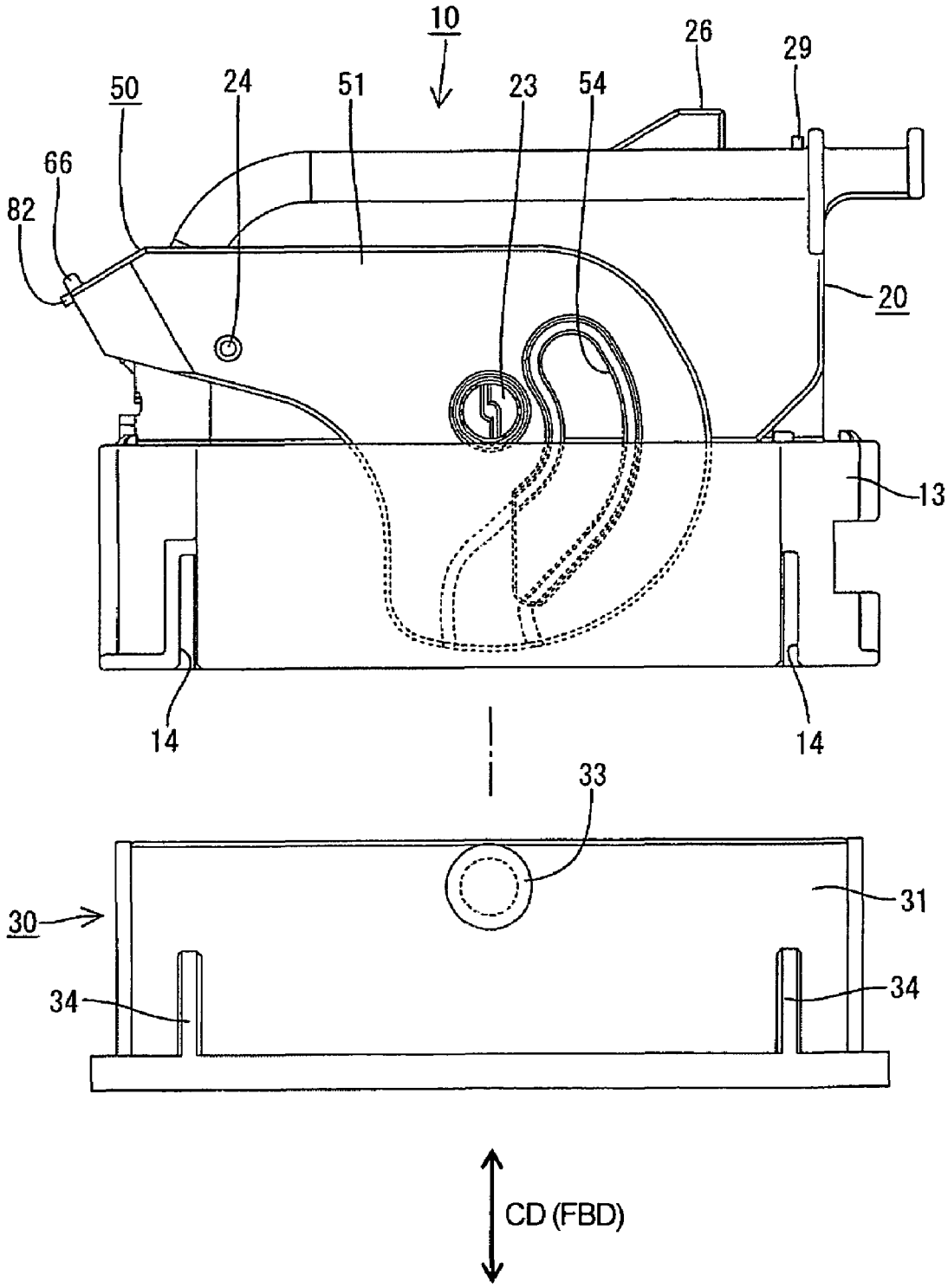
FIG. 1 is a side view of a connector according to one embodiment of the invention before connection.
Figure 2:
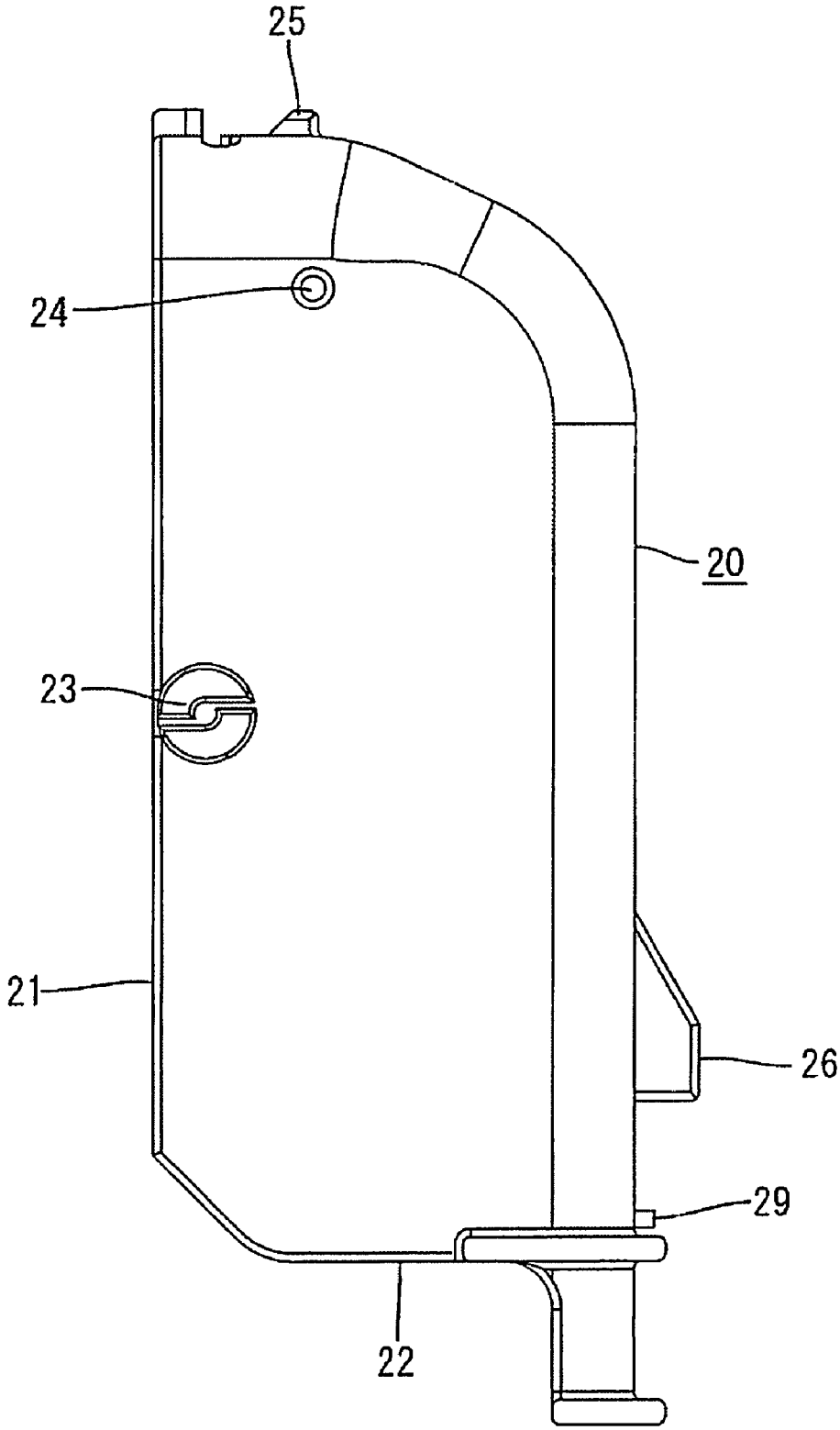
FIG. 2 is a side view of a wire cover.

A lever-type connector according to the invention is described with reference to FIGS. 1 to 15. The connector is a lever-type connector with a female housing 10 and a male housing 30 that are connected along a connecting direction CD by rotating a lever 50 assembled into the female housing 10. In the following description, mating ends of the housings 10, 30 are referred to as the front and the left side in FIG. 1 is referred to as upper side concerning vertical direction.

The male housing 30 is made e.g. of a synthetic resin and has a receptacle 31 in the form of a substantially rectangular tube that opens forwardly. Male terminal fittings (not shown) are mounted through the back wall of the receptacle 31, and the leading ends of the male terminal fittings project into the receptacle 31. Cam pins 33 project in intermediate positions near the front end of the outer surface of each of the left and right walls of the male housing 30, as shown in FIG. 1. Further, guide ribs 34 are provided near rear ends of each outer side surface of the male housing 30 and extend substantially along forward and backward directions FBD.

Figure 12:
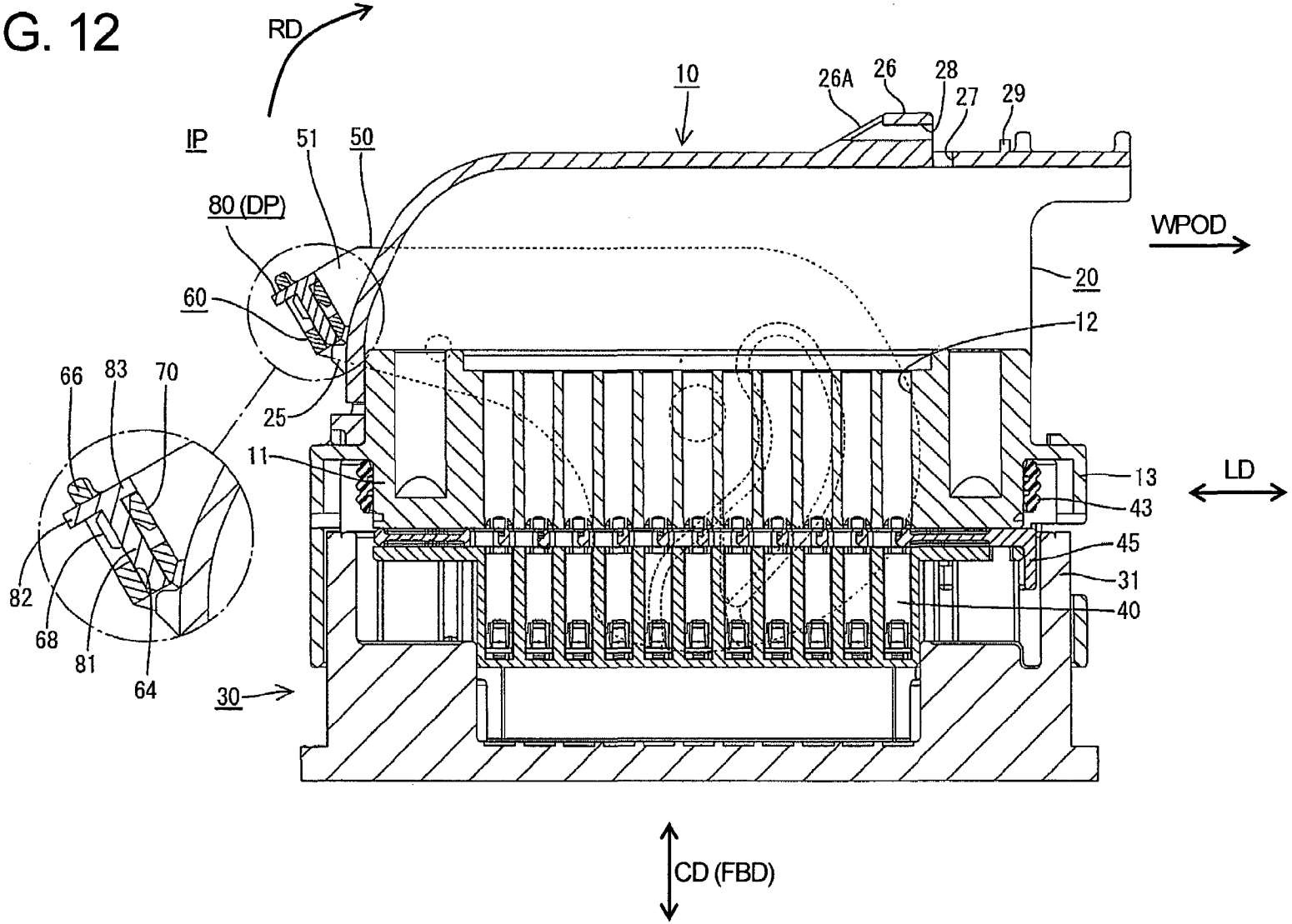
FIG. 12 is a section showing a state when the two housings are lightly fitted with the lever set at a rotation end position.
Figure 13:
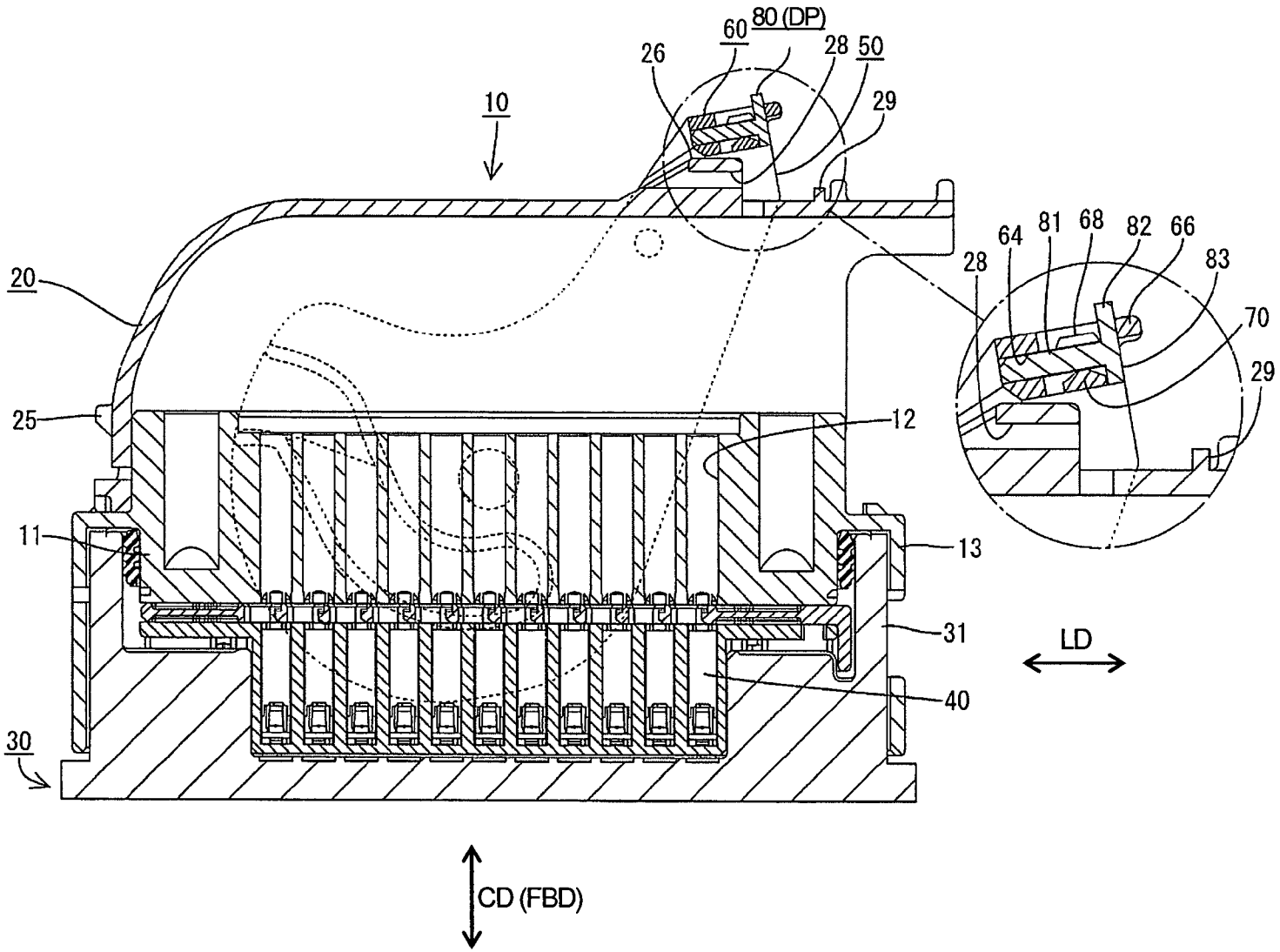
FIG. 13 is a section showing an intermediate state of the connection of the two housings by rotating the lever.

The female housing 10 also is made e.g. of a synthetic resin and includes a terminal accommodating portion 11. A wire cover 20 is mounted on the terminal accommodating portion 11 from behind, and a lever 50 is mounted on the wire cover 20. As shown in FIG. 12, the terminal accommodating portion 11 is substantially a vertically long block and is formed with cavities 12 that are substantially side by side along the longitudinal direction LD. Female terminal fittings 40 are accommodated in the respective cavities 12 at stages. The respective female terminal fittings 40 are secured to unillustrated wires that are bundled and drawn out downward. A retainer 45 is mounted into the terminal accommodating portion 11 and crosses the cavities 12 substantially in the longitudinal direction LD. The retainer 45 is engaged with the female terminal fittings 40 at least partly accommodated in the cavities 12 to retain the female terminal fittings 40 in the cavities 12.

The female housing 10 has a fitting tube 13 that substantially surrounds the side walls of the terminal accommodating portion 11 so that a clearance is defined between the side walls of the fitting tube 13 and side walls of the terminal accommodating portion 11. A forwardly open portion between the fitting tube 13 and the terminal accommodating portion 11 is dimensioned for receiving the receptacle 31 of the male housing 30. A resilient rubber plug 43 is mounted on the side walls of the terminal accommodating portion 11 to provide sealing between the male and female housings 30, 10.

A rearwardly open clearance also is defined between the side walls of the fitting tube 13 and the side walls of the terminal accommodating portion 11 for receiving arms of the lever 50. Two forwardly open guide grooves 14 are formed in each of two substantially opposite side walls of the fitting tube 13, as shown in FIG. 1. The guide ribs 34 of the male housing 30 slide in contact with the respective guide grooves 14 as the two housings 10, 30 are connected. Thus the housings 10, 30 are oriented properly for avoiding a forcible connection and the like.

The connector also includes a wire cover 20 that is made e.g. of a synthetic resin. The wire cover 20 defines a bowl-shape with a forwardly facing mount opening 21 for mounting on the rear of the terminal accommodating portion 11. The wire cover 20 also has a wire draw-out opening 22. The inner surface of the wire cover 20 is configured to guide the wires from the rear of the terminal accommodating portion 11 towards the wire draw-out opening 22. A wire pull out direction WPOD extends downward from the wire draw-out opening 22.

A shaft projects substantially at a longitudinal middle position near the front end of the outer surface of each of the opposite side walls of the wire cover 2023 for rotatably supporting the lever 50. Further, a substantially cylindrical partial locking projection 24 is formed near the upper wall on the outer surface of each opposite side wall of the wire cover 20 for holding the lever 50 at a rotation initial position IP. The upper wall of the wire cover 20 has an outer surface that is curved from the rear end up to a position near the front end and becomes substantially straight along forward and backward directions FBD from this position on. Left and right partial locking projections 25 are formed on this outer surface. The partial locking projections 25 contact the front edge of a lever operating portion 52 to hinder any further forward rotation of the lever 50 and to position the lever 50 at the initial position IP.

Figure 3:
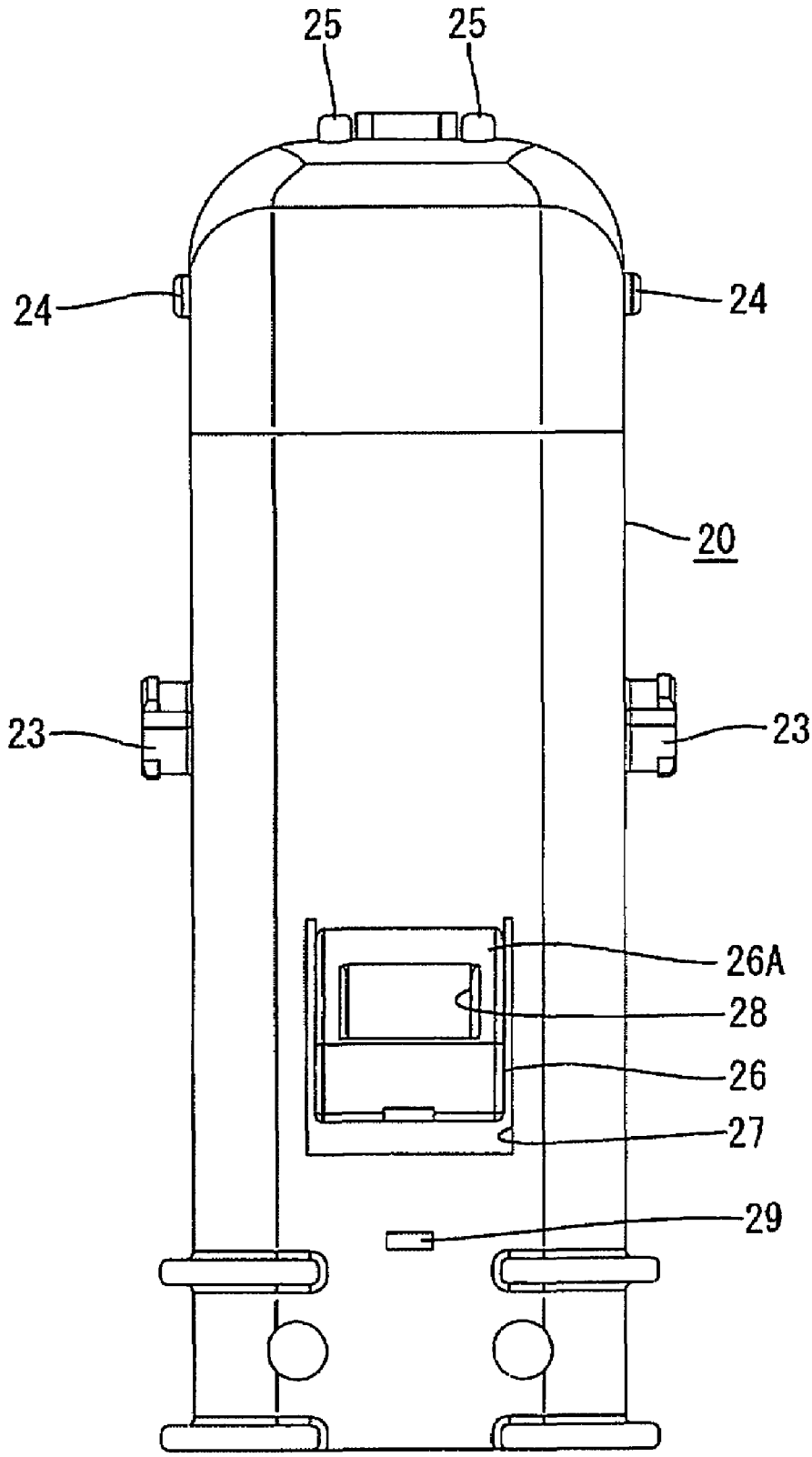
FIG. 3 is a rear view of the wire cover.
Figure 4:
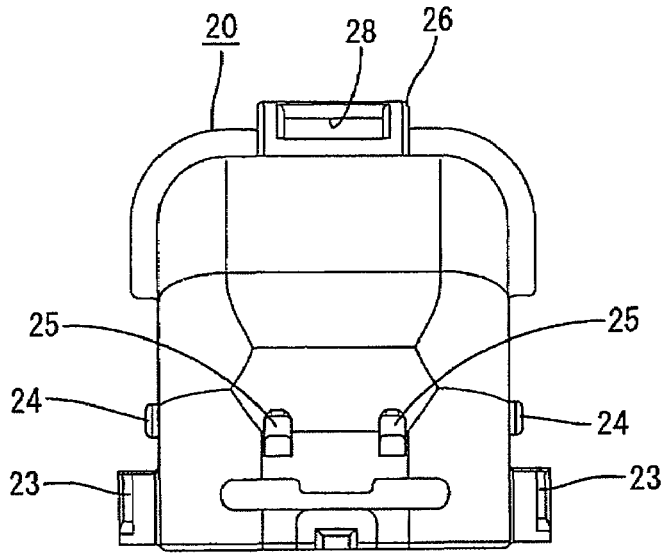
FIG. 4 is a plan view of the wire cover.

As shown in FIGS. 3 and 12, the rear wall of the wire cover 20 extends substantially vertically along the longitudinal direction LD, and a lock 26 is formed near the bottom end on the outer surface of the rear wall for locking the lever 50 at a rotation end position EP. The lock 26 is a substantially trapezoidal block with a slanted upper surface 26A that slopes down towards the outer side. The lock 26 is in an area inside a substantially U-shaped slit 27, and is thicker than the surrounding part. A lock hole 28 extends vertically through a middle portion the lock 26 and makes an opening in the slanted surface 26A of the lock 26. The lock hole 28 is substantially rectangular when viewed from behind, but defines a wide slit when viewed from above, as shown in FIG. 4.

An unlocking projection 29 is provided below the lock 26 on the outer surface of the rear wall of the wire cover 20. The lever operating portion 52 is fit into a clearance between the unlocking projection 29 and the lock 26. The projecting end of the unlocking projection 29 is substantially at the same height as the inner surface of the lock hole 28.

Figure 5:
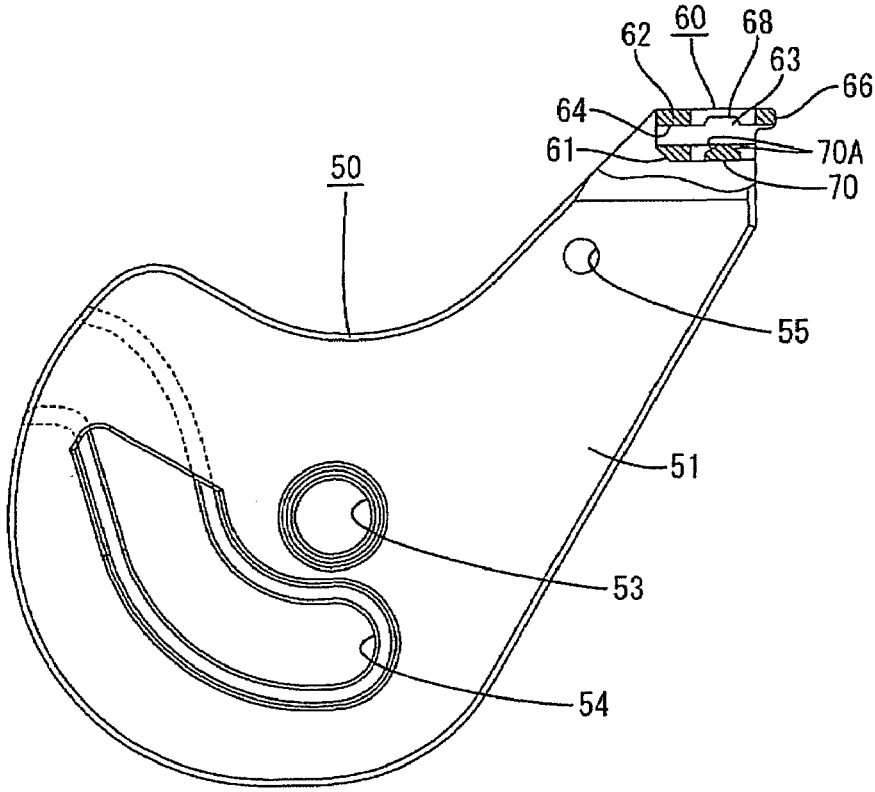
FIG. 5 is a side view partly in section of a lever.
Figure 6:
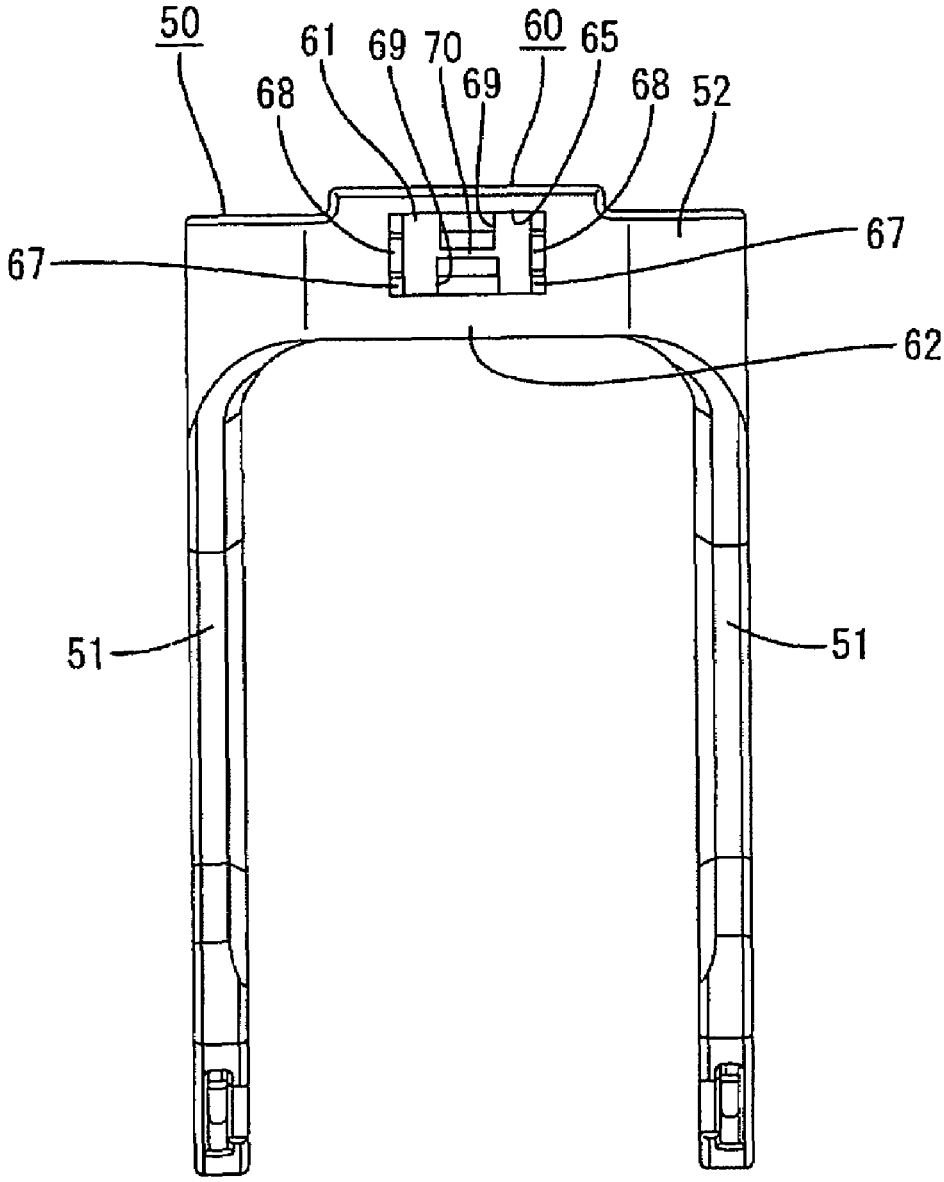
FIG. 6 is a plan view of the lever.
Figure 7:
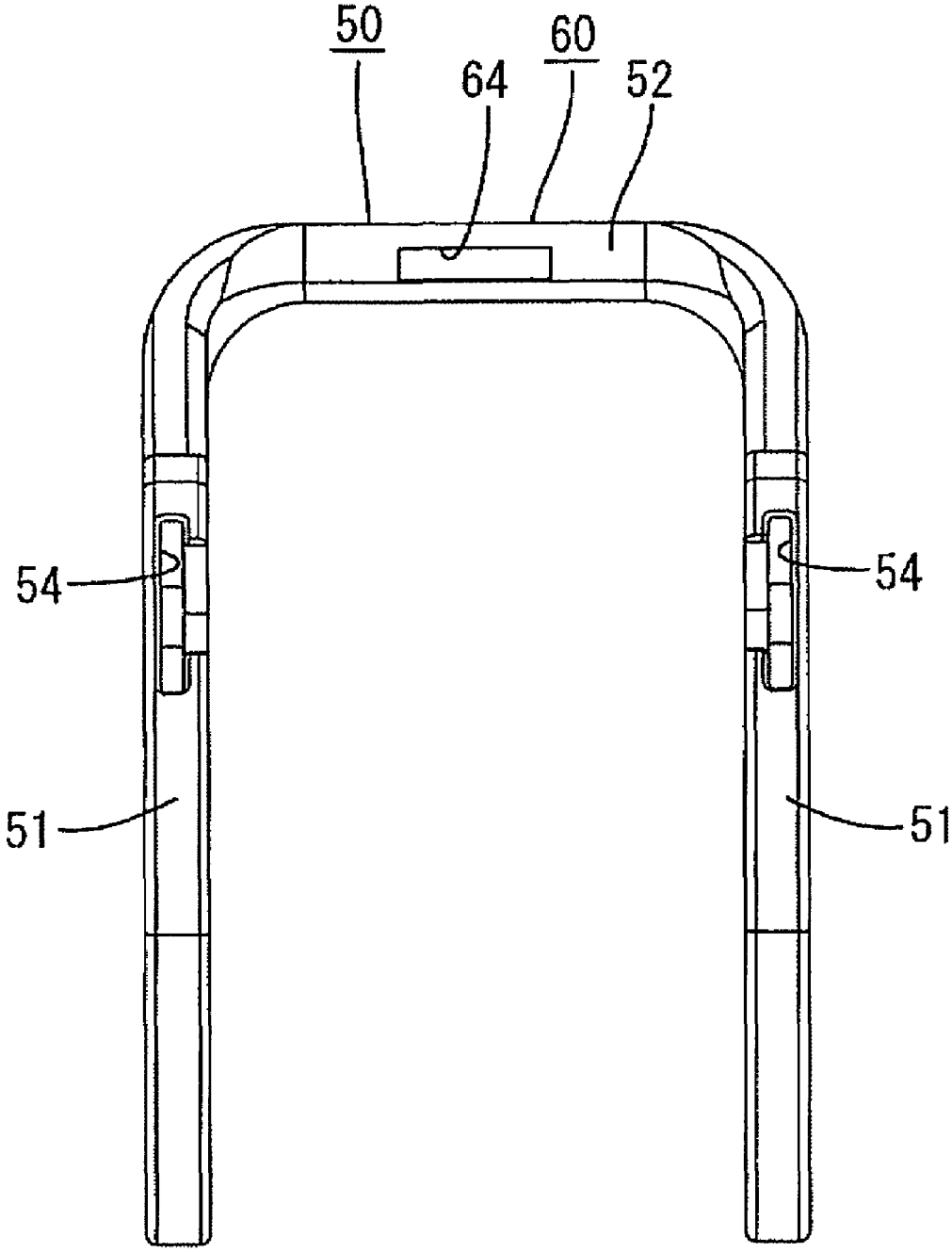
FIG. 7 is a front view of the lever.

The lever 50 is similarly made e.g. of a synthetic resin and has two plate-shaped arms 51 that project from opposite ends of an operating portion 52 to define a gate-shape, as shown in FIGS. 5 to 7. Each arm 51 has a bearing 53 engageable with the corresponding shaft 23, and a cam groove 54 with an entrance at the outer peripheral edge of the arm 51. The lever 50 is rotatable along a rotating direction RD between the rotation initial position IP and the rotation end position EP. Entrances of the cam grooves 54 face forward along the connecting direction CD when the lever 50 is at the rotation initial position IP for receiving the cam pins 33 of the male housing 30 as the two housings 10, 30 are fit lightly together. A cam action is generated between the cam grooves 54 and the cam pins 33 to pull the housings 10, 30 together as the lever 50 is rotated in the rotating direction RD from the rotation initial position IP to the rotation end position EP (in the direction of the arrow shown in FIGS. 9 and 12). A partial lock hole 55 is formed in each arm 51 near the lever operating portion 52 and engages the corresponding partial locking projection 24 on the female housing 10 at the rotation initial position IP.

The lever operating portion 52 is a relatively thick flat plate that extends in the width direction, and an accommodating portion 60 is formed substantially in the widthwise middle of the lever operating portion 52. More specifically, the accommodating portion 60 has a base wall 61, left and right side walls 63 that project up from the opposite lateral edges of the base wall 61, and a facing wall 62 that faces the base wall 61 at a specified distance therefrom. The upper surface of the facing wall 62 forms at least a part of the upper surface of the lever operating portion 52.

A guide hole 64 is defined between the base wall 61 and the facing wall 62 and penetrates the accommodating portion 60 in forward and backward directions FBD. As shown in FIG. 7, the guide hole 64 is a wide slit when the lever operating portion 52 is viewed from the front. The guide hole 64 communicates with the lock hole 28 in the wire cover 20 when the lever 50 reaches the rotation end position EP.

A substantially rectangular window 65 is formed in the facing wall 62, and a detachment preventing portion 66 projects substantially back behind the window 65 in the facing wall 62.

A stepped surface 67 bulges in at an intermediate position with respect to the depth direction on each of the lateral walls 63, and an auxiliary stopper 68 projects from the stepped surface 67 substantially towards the window 65. Both front and rear surfaces of the auxiliary stoppers 68 are slanted or rounded surfaces.

Front and rear slits 69 are formed at the front and rear ends of the base wall 61 and penetrate the base wall 61 in the thickness direction. A stopper 70 is provided between the two slits 69. Both slits 69 communicate with the window 65. Additionally, the rear slit 69 opens in the rear end surface of the lever operating portion 52. The stopper 70 has front and rear guiding slanted surfaces 70A that are inclined more moderately than the auxiliary stoppers 68. The upper surface of the stopper 70 is substantially flat and forms part of the upper surface of the base wall 61. The stopper 70 is juxtaposed to the unlocking projection 29 with substantially no clearance when the lever 50 reaches the rotation end position EP. A projecting distance of the stopper 70 is substantially equal to a projecting distance of the unlocking projection 29. Accordingly, the stopper 70 and the unlocking projection 29 are arranged so that the upper end positions thereof are substantially aligned.

Figure 8A:
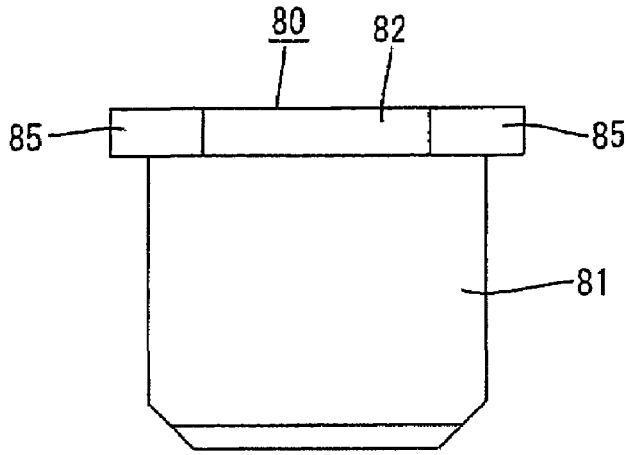
FIGS. 8(A), 8(B) and 8(C) are a plan view, a front view and a side view of a detecting element, respectively.
Figure 8B:
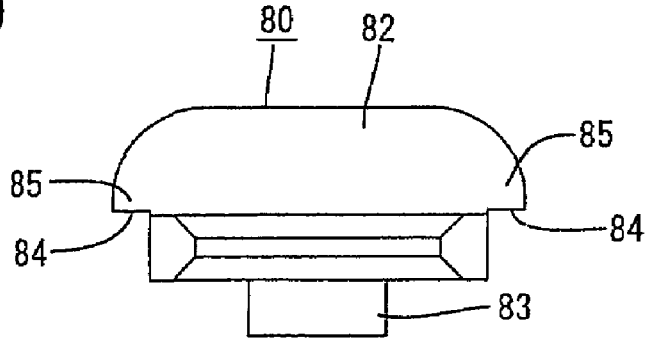
Figure 8C:
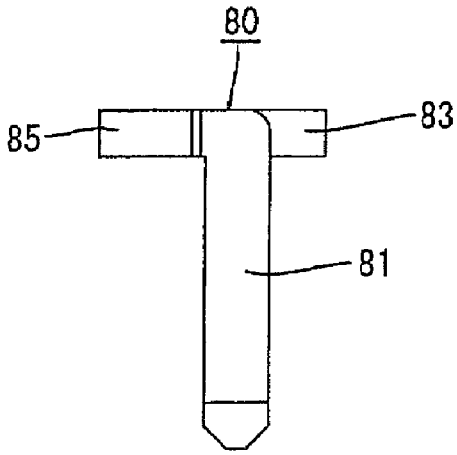

A detector 80 is mounted into the accommodating portion 60 and similarly is made e.g. of a synthetic resin. The detector 80 has a main portion 81 and a flat plate-shaped operable portion 82 projects up the main portion 81 projecting forward from the bottom end of the operable portion 82, and an engaging portion 83 projecting down towards the wire cover 20 from the bottom rear edge of the main portion 81 as shown in FIG. 8(B). The detector 80 is substantially T-shaped when viewed sideways.

The operable portion 82 has a wide rectangular shape with rounded upper corners. Front and rear surfaces of the operable portion 82 define finger placing surfaces for an operator. Thus, an operator can pinch the operable portion 82 e.g. with fingers when the detector 80 is in the accommodating portion 60 and can push the operable portion 82 to move the detector 80 from a standby position SP to a detecting position DP while crossing the window 65. An upper part of the operable portion 82 projects up from the upper surface of the lever operating portion 52 when the detector 80 is in the accommodating portion 60 to facilitate pinching and operation (see FIG. 1). The rear surface of the upper part of the operable portion 82 contacts the front surface of the detachment preventing portion 66 when the detector 80 is at the standby position SP to prevent a backward detachment of the detector 80.

The main portion 81 is a substantially flat resiliently deformable plate that extends substantially normal to the operable portion 82. The main portion 81 is coupled to the bottom end of the operable portion 82 via steps, excluding both lateral edges 85. Front surfaces of both lateral edges 85 of the operable portion 82 contact the rear surfaces of the auxiliary stoppers 68 of the accommodating portion 60 when the detector 80 is at the standby position SP (see e.g. FIGS. 12–14) and prevent the detector 80 from being pushed to the detecting position DP. The free front end of the main portion 81 is inserted in the guide hole 64 of the accommodating portion 60, and movements of the detector 80 are ensured by sliding movements of the main portion 81 along the guide hole 64. The free end of the main portion 81 is beveled over substantially the entire periphery to facilitate insertion into the guide hole 64.

The engaging portion 83 is substantially rectangular and has a width less than about half, preferably about one fourth the width of the operable portion 82. The engaging portion 83 is coupled to a substantially middle part of the bottom rear edge of the main portion 81, and is juxtaposed to the operating portion 82 on substantially the same plane. The engaging portion 83 is in the rear slit 69 of the stopper 70 and contacts the rear surface of the stopper 70 of the accommodating portion 60 when the detector 80 is at the standby position SP to prevent movement of the detector 80 towards the detecting position DP. On the other hand, the engaging portion 83 contacts the unlocking projection 29 on the female housing 10 when the lever 50 reaches the rotation end position EP. Thus, the main portion 81 deforms resiliently (see FIG. 14) and the engaging portion 83 disengages from the stopper 70.

The detector 80 is inserted through the window 65 and into the accommodating portion 60 of the lever 50 prior to connecting the two housings 10, 30. More particularly, the free end of the main portion 81 is deformed resiliently in a deforming direction DD and inserted into the guide hole 64, and the engaging portion 83 is accommodated into the rear slit 69 of the base wall 61. The contact of the engaging portion 83 with the stopper 70 prevents the detector 80 from moving forward towards the detecting position DP; the contact of the operable portion 82 with the detachment preventing portion 66 prevents the detector 80 from moving backward; and the insertion of the free end of the main portion 81 into the guide hole 64 prevents the detector 80 from moving vertically (see FIG. 12). The lever 50 is mounted on the female housing 10 with the detector 80 at the standby position SP, and is held at the rotation initial position IP.

Figure 9:
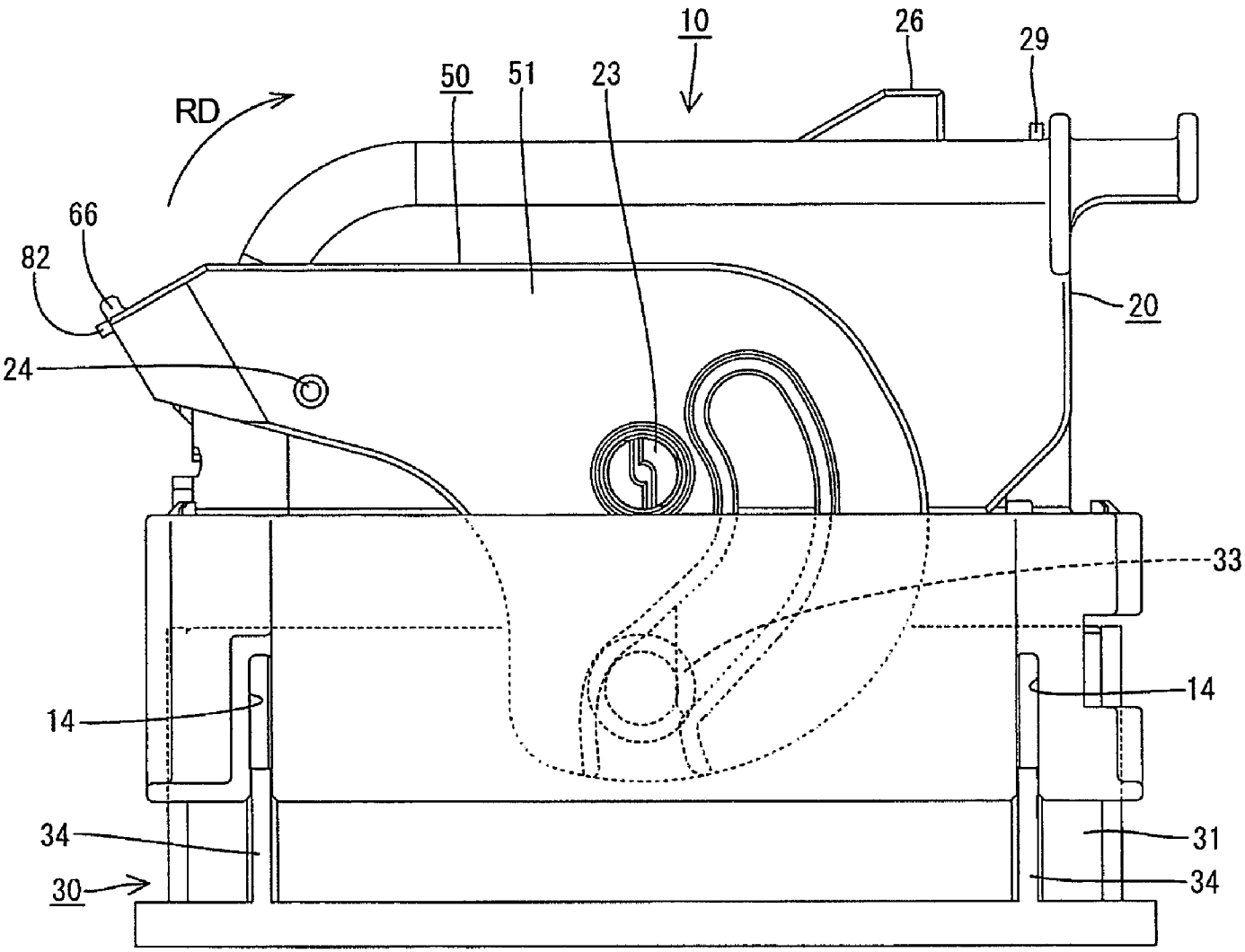
FIG. 9 is a side view showing a state when two housings are lightly fitted with the lever set at a rotation initial position.
Figure 10:
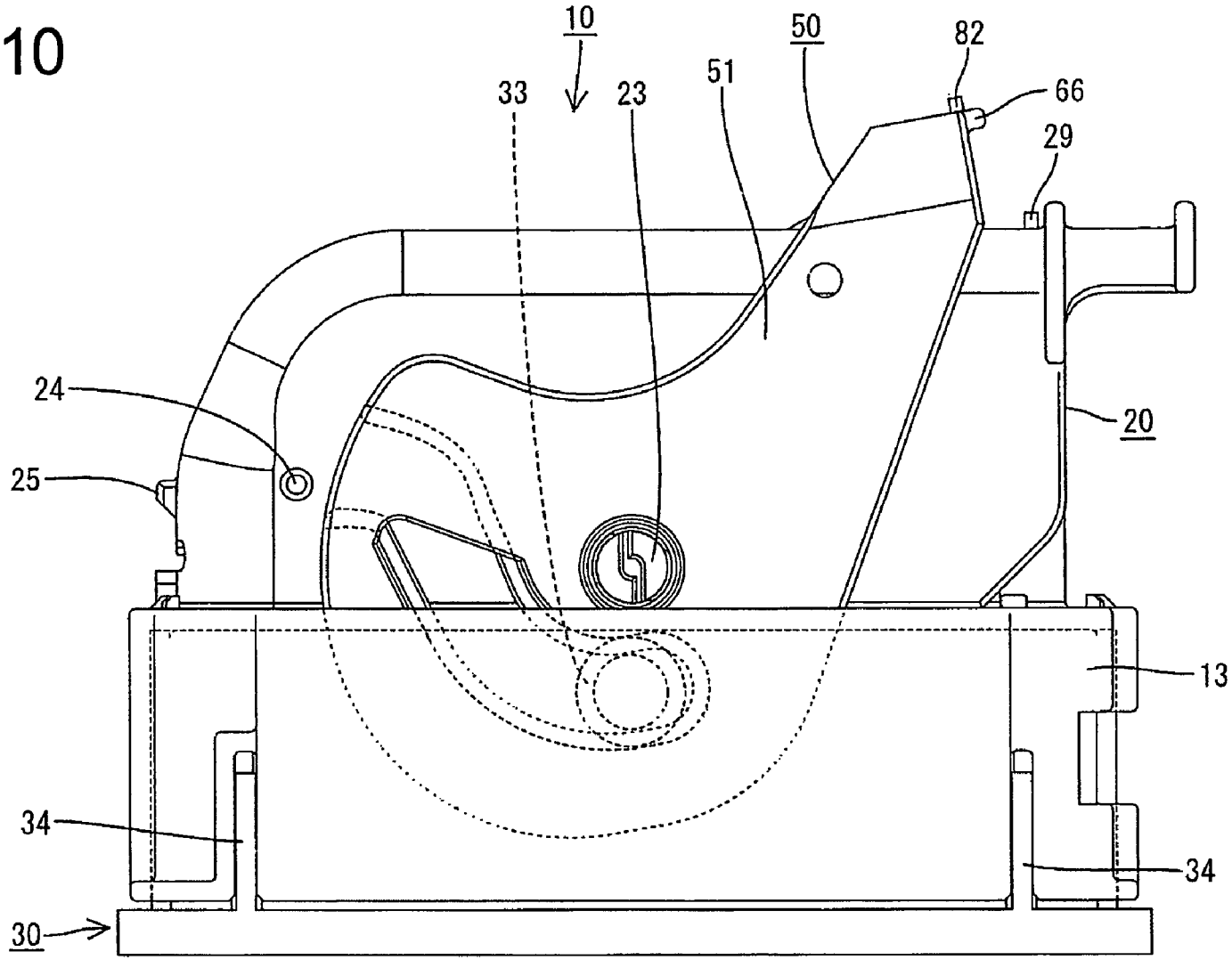
FIG. 10 is a side view showing an intermediate state of the connection of the two housings by rotating the lever.
Figure 11:
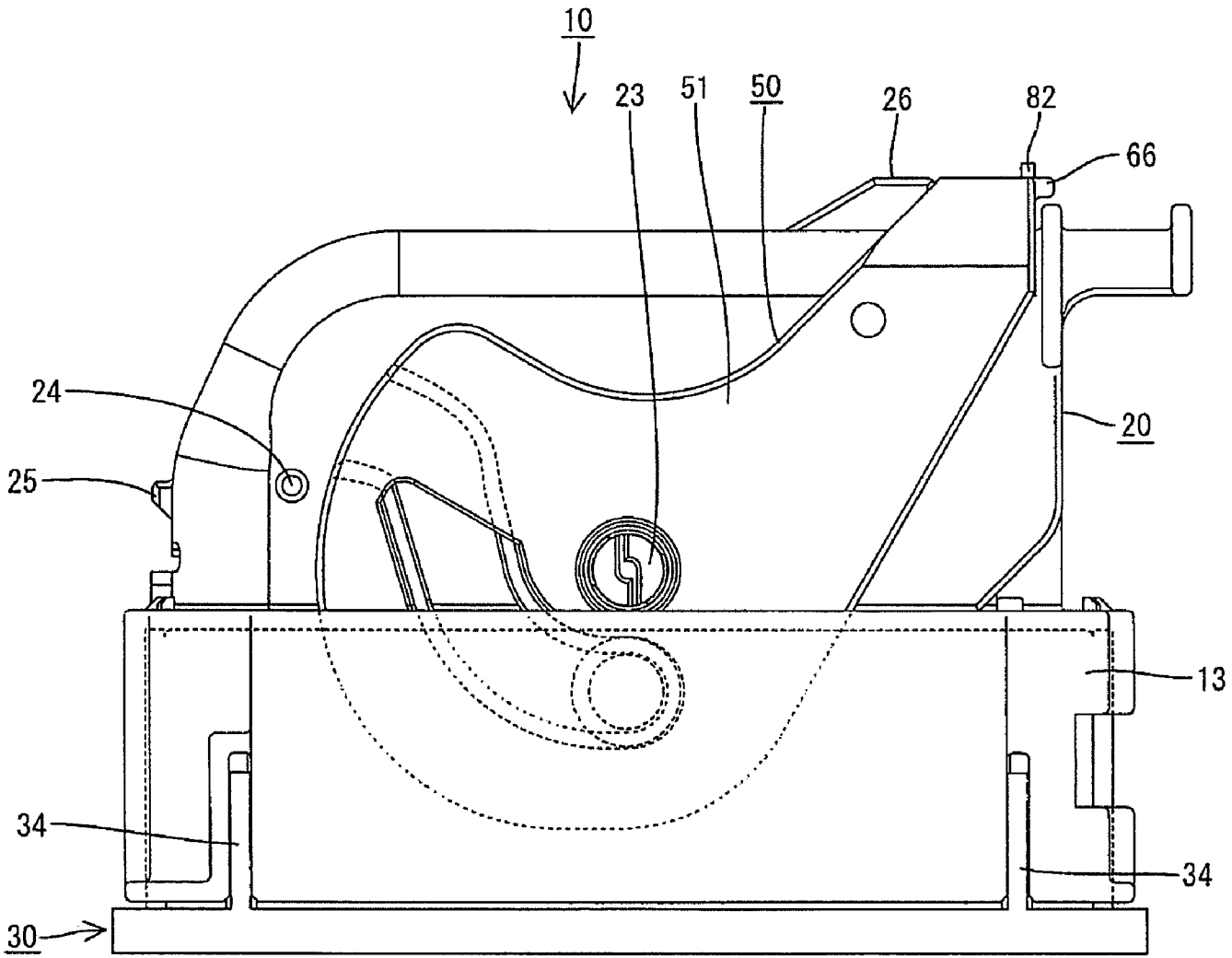
FIG. 11 is a side view showing a state when the lever is rotated to the rotation end position to properly connect the two housings.
Figure 14:
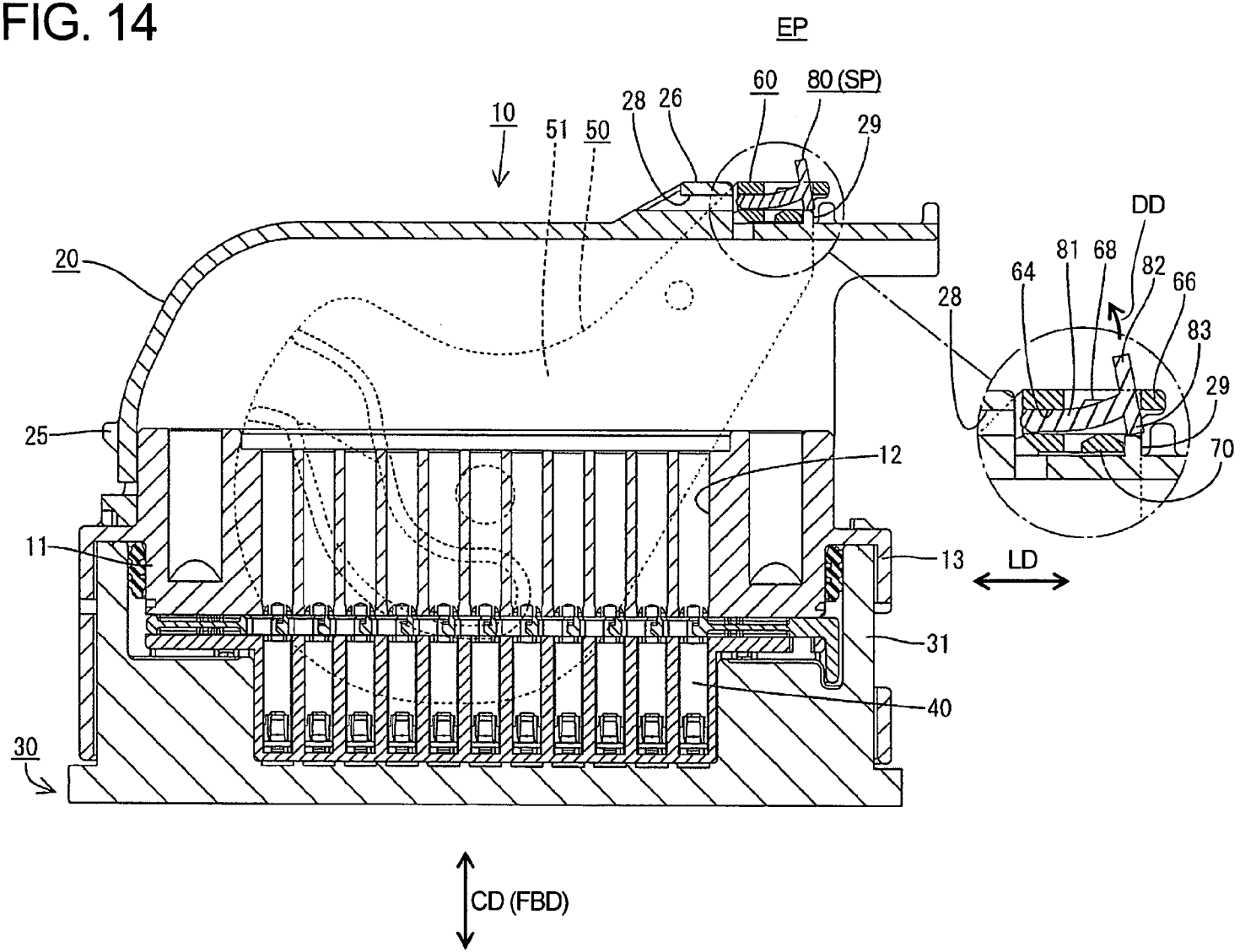
FIG. 14 is a section showing the state when the lever is rotated to the rotation end position to properly connect the two housings.

As shown in FIG. 1, the male and female housings 30, 10 are disposed in facing relationship and then the female housing 10 is fit lightly into the receptacle 31 of the male housing 30. The lever operating portion 52 then is held to rotate the lever 50 in the direction of the arrow RD, as shown in FIG. 9. The lever operating portion 52 rests right below the lock 26 of the wire cover 20, as shown in FIG. 11, when the lever 50 reaches the rotation end position EP. Then, as shown in FIG. 14, the end surface of the engaging portion 83 of the detector 80 contacts the end surface of the unlocking projection 29 of the wire cover 20. As a result, the base end of the main portion 81 is deformed resiliently in the deforming direction DD with the free end thereof inserted in the guide hole 64 (see FIG. 14). Further, the engaging portion 83 comes out of the rear slit 69 of the base wall 61 and disengages from the stopper 70 due to the resilient deformation of the main portion 81 in the deforming direction DD.

Figure 15:
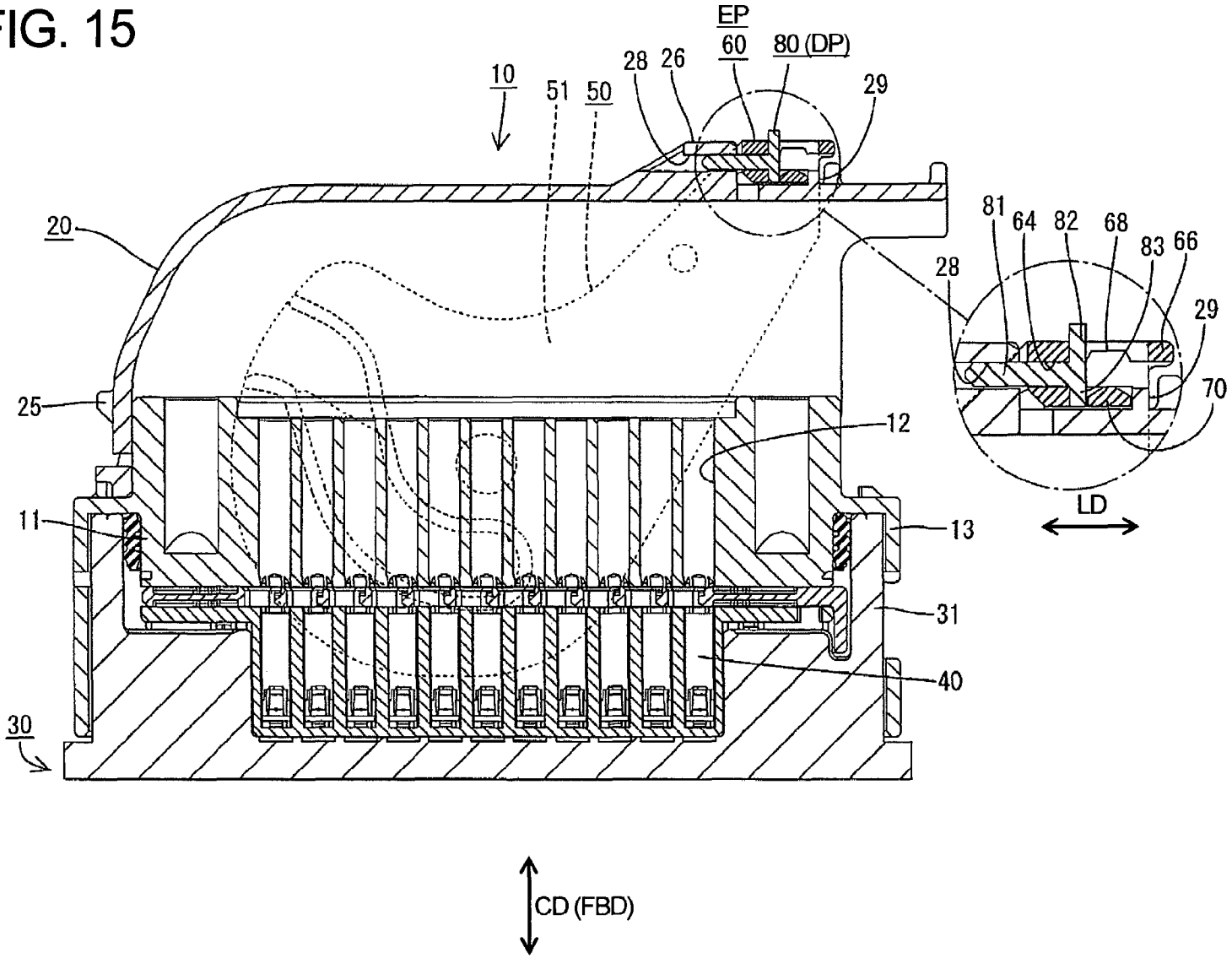
FIG. 15 is a section showing a state when the detecting element is pushed with the two housings properly connected.

The engaging portion 83 cannot move over the stopper 70. Thus, the guide hole 64 substantially aligns with the lock hole 28, and the operable portion 82 of the detector 80 can be operated (e.g. pinched with fingers) to push the detector 80 towards the lock 26 and towards the detecting position DP. As shown in FIG. 15, the free end of the main portion 81 of the detector 80 is guided by the guide hole 64 and enters the lock hole 28 of the lock 26. Accordingly, the detector 80 is locked into the wire cover 20 and into the female housing 10 via the main portion 81. The engaging portion 83 is accommodated into the front slit 69 of the base wall 61 and the main portion 81 is restored resiliently in a direction substantially opposite to the deforming direction DD substantially as the detector 80 arrives at the detecting position DP. As a result proper connection of the housings 10, 30 can be detected.

On the other hand, the engaging portion 83 and the stopper 70 are still in contact with each other if the lever 50 has not yet reached the rotation end position EP. Thus, even if the rotation of the lever 50 is stopped in this state, the detector 80 cannot be pushed towards the detecting position DP, and the operator knows that the housings 10, 30 have not been connected properly.

As described above, the engaging portion 83 contacts the unlocking projection 29 to deform the main portion 81 resiliently in the deforming direction DD. Thus, the engaging portion 83 disengages from the stopper 70 when the two housings 10, 30 are connected properly, and the detector 80 can be pushed to the detecting position DP. On the other hand, the engaging portion 83 and the stopper 70 are still in contact if the housings are not connected properly and the detector 80 cannot be pushed to the detecting position DP. In this way, the connected state of the two housings 10, 30 can be known by the detector 80. Additionally, the construction of a forming die can be simplified since the construction of the male housing 30 is simpler than the prior art.

The main portion 81 of the detector 80 is guided by the guide hole 64 into the lock hole 28 when the two housings 10, 30 are connected properly. Thus, the detector 80 can be moved smoothly.

The lever 50 can be locked into the female housing 10 by pushing the detector 80 into the lock hole 28 and to the detecting position DP. Since the detector 80 locks the lever 50, a separate lock for the lever 50 is not needed.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The female housing has the lock only for embodiments where the detector must have a lever locking function.

According to the invention, the stopper may hold the detector at the standby position SP and the auxiliary stopper can be dispensed with.

The rotating direction of the lever may be in a direction opposite from the direction DD of FIGS. 9 and 12 of the foregoing embodiment.

The lever is assembled to the female housing in the foregoing embodiment. However, it may be assembled to the male housing.

The invention is also applicable to movable members other than rotatable levers, such as a slider being that is linearly movable for displaying a cam action.

What is claimed is:

1. A connector, comprising:

a housing (10) connectable with a mating housing (30) and being formed with an unlocking portion (29);

a movable member (50) movably mountable on the housing (10) and having at least one cam surface (54) for generating a cam action in cooperation with a follower (33) on the mating housing (30) as the movable member (50) is displaced, a stopper (70) being formed on the movable member (50);

a resiliently deformable detector (80) assembled with the movable member (50) and movable between a standby position (SP) and a detecting position (DP), the stopper (70) on the movable member (50) contacting the detector (80) and preventing the detector (80) from being pushed from the standby position (SP) to the detecting position (DP) when the housing (30) is not yet connected properly with the mating housing (30), the unlocking portion (29) on the housing (10) deforming the detector (80) out of engagement with the stopper (70) for permitting the detector (80) to be pushed to the detecting position (DP) when the housing (10) is connected properly with the mating housing (30).

2. The connector of claim 1, wherein the movable member (50) comprises a lever (50) rotatably mountable on the housing (10), and the housing (10) is substantially properly connected with the mating housing (30) by a cam action resulting from rotating the lever (50).

3. The connector of claim 1, wherein the detector (80) includes a main portion (81) projecting substantially in a pushing direction of the detector (80) and the movable member (50) includes an accommodating portion (60) for accommodating the detector (80).

4. The connector of claim 3, wherein the accommodating portion (60) has a guide hole (64) for receiving a free end of the main portion (80) and for guiding the detector (80) to the detecting position (DP).

5. The connector of claim 4, wherein the housing (10) includes a receiving portion (28) that communicates with the guide hole (64) when the housing (10) is connected properly with the mating housing (30), and the main portion (81) enters the receiving portion (28) as an operable portion (82) of the detector (80) is pushed, whereby the movable member (50) is locked into the housing (10).

6. The connector of claim 1, wherein a detachment preventing portion (66) is provided at the movable member (60) for preventing detachment of the detector (80) by contacting the detector (80).

7. The connector of claim 1, wherein the detector (80) can be moved between the standby position (SP) and the detecting position (DP) in a direction intersecting a movement direction (RD) of the movable member (50).

8. The connector of claim 1, wherein, when the detector (80) is at the standby position (SP), an operable portion (82) of the detector (80) contacts at least one auxiliary stopper (68) of an accommodating portion (60) of the movable element (50) for accommodating the detector (80) to prevent the detector (80) from being pushed to the detecting position (DP).

9. A connector assembly comprising the connector of claim 1 and a mating connector connectable therewith.

10. The connector assembly of claim 9, wherein at least one guide rib (34) is provided on one (30) of the housing (10) and the mating housing (30) for sliding contact with at least one guide groove (14) on the other (10) of the housing (10) and the mating housing (30) as the two housings (10, 30) are connected for properly orienting the two housings (10, 30).

* * * * *